US011388956B2

(12) United States Patent
Hatfield et al.

(10) Patent No.: US 11,388,956 B2
(45) Date of Patent: Jul. 19, 2022

(54) CLOSURE SYSTEM FOR AN ARTICLE OF FOOTWEAR

(71) Applicant: NIKE, Inc., Beaverton, OR (US)

(72) Inventors: Tinker L. Hatfield, Portland, OR (US); Risha Dupre, Tigard, OR (US); Austin Orand, Portland, OR (US); Haley Toelle, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 205 days.

(21) Appl. No.: 16/678,480

(22) Filed: Nov. 8, 2019

(65) Prior Publication Data

US 2020/0205524 A1 Jul. 2, 2020

Related U.S. Application Data

(60) Provisional application No. 62/785,440, filed on Dec. 27, 2018.

(51) Int. Cl.

| | |
|---|---|
| ***A43C 11/00*** | (2006.01) |
| ***A43C 1/06*** | (2006.01) |
| ***A43C 11/16*** | (2006.01) |
| ***A43C 11/14*** | (2006.01) |
| *A43C 7/06* | (2006.01) |

(52) U.S. Cl.

CPC ..... *A43C 11/1493* (2013.01); *A43C 1/06* (2013.01); *A43C 11/008* (2013.01); *A43C 7/06* (2013.01); *A43C 11/165* (2013.01)

(58) Field of Classification Search

CPC ..... A43C 11/1493; A43C 1/06; A43C 11/165; A43C 11/008; A43C 11/006; A43C 7/06; A43C 7/08; A43C 11/08

See application file for complete search history.

(56) References Cited

U.S. PATENT DOCUMENTS

| | | | | |
|---|---|---|---|---|
| 786,406 | A | 4/1905 | Boynton | |
| 1,733,640 | A | 10/1929 | Wright | |
| 2,845,233 | A | 7/1958 | Pfankuch et al. | |
| 3,834,048 | A * | 9/1974 | Maurer | A43C 11/16 36/50.1 |
| 4,007,532 | A | 2/1977 | Einhorn et al. | |
| 4,173,332 | A | 11/1979 | DuLondel | |
| 4,350,313 | A | 9/1982 | Adomeit | |

(Continued)

FOREIGN PATENT DOCUMENTS

| | | | |
|---|---|---|---|
| CN | 107920618 | A | 4/2018 |
| CN | 109068807 | A | 12/2018 |

(Continued)

*Primary Examiner* — Katharine G Kane

(74) *Attorney, Agent, or Firm* — Quinn IP Law

(57) ABSTRACT

An article of footwear may comprise an upper and a closure system. The closure system may include a strap, a tensioning cable, and a plurality of pulleys. The strap may have a fixed end fixed relative to the upper, a free end selectively securable to the upper in a fastened position, and an elastic portion between the fixed end and the free end. The closure system may include a tensioning cable anchored to the upper and secured to the strap. The closure system may also include a plurality of pulleys anchored to the upper and engaging the tensioning cable. The tensioning cable may be configured to tighten against the upper when the elastic portion of the strap stretches as the free end of the strap is pulled.

19 Claims, 5 Drawing Sheets

(56) References Cited

U.S. PATENT DOCUMENTS 4,513,520 A * 4/1985 Koch ..... A43B 5/0405 36/10
4,619,418 A 10/1986 Butenop
4,671,859 A 6/1987 Pliefke
4,811,498 A * 3/1989 Barret ..... A43B 7/1495 36/117.2
4,937,952 A * 7/1990 Olivieri ..... A43C 11/16 36/118.9
5,345,697 A * 9/1994 Quellais ..... A43B 11/00 24/712
5,408,761 A * 4/1995 Gazzano ..... A43B 5/00 36/102
5,425,185 A * 6/1995 Gansler ..... A43C 11/00 36/50.1
5,463,822 A * 11/1995 Miller ..... A43C 11/00 36/50.1
5,537,763 A * 7/1996 Donnadieu ..... A43C 1/00 36/50.1
5,687,460 A 11/1997 Foffano et al.
6,189,913 B1 2/2001 Morrow et al.
6,671,980 B1 * 1/2004 Liu ..... A43B 11/00 24/712
6,694,643 B1 * 2/2004 Hsu ..... A43C 1/00 24/712.1
6,711,787 B2 3/2004 Jungkind et al.
7,370,440 B1 * 5/2008 Cole, III ..... A43B 5/003 36/50.1
8,713,820 B2 * 5/2014 Kerns ..... A43C 11/004 36/50.1
9,364,046 B2 * 6/2016 Adams ..... A43C 11/1493
9,629,417 B2 4/2017 Cavanagh et al.
D815,562 S 4/2018 Schommer et al.
10,149,514 B2 * 12/2018 Adams ..... A43C 7/00
10,624,423 B2 * 4/2020 Grand ..... A43C 11/165
2002/0178548 A1 12/2002 Freed
2003/0020288 A1 1/2003 Junking et al.
2003/0167655 A1 * 9/2003 Sussmann ..... A43C 11/008 36/50.1
2003/0204970 A1 * 11/2003 Liu ..... A43B 1/0081 36/50.1
2006/0021204 A1 2/2006 Young
2007/0277398 A1 * 12/2007 Davis ..... A43B 1/0081 36/50.1
2008/0066344 A1 * 3/2008 Kelley ..... A43C 11/1493 36/50.1
2009/0300947 A1 * 12/2009 Babolat ..... A43B 23/17 36/114
2010/0299968 A1 * 12/2010 Matsueda ..... A43C 15/02 36/134
2010/0319216 A1 * 12/2010 Grenzke ..... A43C 1/00 36/54
2011/0258876 A1 10/2011 Baker et al.
2011/0308892 A1 12/2011 Saarelainen et al.
2012/0079741 A1 * 4/2012 Kohatsu ..... A43C 1/04 36/50.1
2012/0246897 A1 10/2012 Lee
2013/0160328 A1 * 6/2013 Hatfield ..... A43B 13/141 36/103
2013/0255105 A1 * 10/2013 Bishop ..... A43B 3/126 36/88
2014/0041259 A1 * 2/2014 Oouchi ..... A43B 5/14 36/131
2014/0196313 A1 7/2014 Hatfield et al.
2014/0196317 A1 * 7/2014 Katz ..... A43C 11/1493 36/89
2014/0223779 A1 * 8/2014 Elder ..... A43B 23/0245 36/103
2014/0338223 A1 * 11/2014 Adams ..... A43C 11/1493 36/50.1
2015/0089839 A1 * 4/2015 James ..... A43B 13/18 36/102
2016/0044994 A1 * 2/2016 Soderberg ..... A43C 11/165 36/97
2016/0120264 A1 * 5/2016 Bardini ..... A43C 1/00 36/50.1
2016/0157561 A1 * 6/2016 Schum ..... A43C 11/165 242/390
2016/0270484 A1 * 9/2016 Zadnik ..... A43B 3/06
2016/0331084 A1 * 11/2016 Xanthos ..... A43C 5/00
2016/0338449 A1 * 11/2016 Steuerwald ..... A43B 5/14
2016/0353833 A1 * 12/2016 Hesterberg ..... A43B 13/223
2017/0042290 A1 * 2/2017 Hatfield ..... A43B 3/02
2017/0065029 A1 * 3/2017 Bordin ..... A43C 1/003
2017/0231326 A1 * 8/2017 Fisher ..... A43C 11/1493 24/68 SK
2017/0332734 A1 11/2017 Orand
2017/0332735 A1 * 11/2017 Grand ..... A43C 11/16
2017/0354204 A1 * 12/2017 Giacobone ..... A43B 23/0245
2018/0055146 A1 * 3/2018 Adams ..... A43C 1/00
2018/0110295 A1 * 4/2018 Dyer ..... A43C 1/04
2018/0125168 A1 * 5/2018 Beers ..... A43B 3/0005
2018/0242692 A1 * 8/2018 Houng ..... A43C 11/1493
2018/0295942 A1 * 10/2018 Drake ..... A43B 11/00
2018/0352898 A1 * 12/2018 Onoda ..... A43C 11/165
2019/0208863 A1 * 7/2019 Adams ..... A43C 11/006
2019/0246747 A1 * 8/2019 Bock ..... A43B 3/0005
2019/0307209 A1 * 10/2019 Houng ..... A43C 1/04
2019/0313741 A1 * 10/2019 Bell ..... A43B 3/06
2020/0077748 A1 3/2020 Dyer et al.
2020/0207595 A1 7/2020 Hatfield et al.

FOREIGN PATENT DOCUMENTS

DE 10239954 A1 3/2004
DE 202015101056 U1 6/2015
DE 102018201019 A1 8/2018
KR 20040049723 A 6/2004

* cited by examiner

CLOSURE SYSTEM FOR AN ARTICLE OF FOOTWEAR

CROSS-REFERENCE TO RELATED APPLICATION

This application claims the benefit of priority to U.S. Provisional Application No. 62/785,440, filed Dec. 27, 2018, which is hereby incorporated by reference in its entirety.

TECHNICAL FIELD

The present disclosure generally relates to an article of footwear having a closure system with a strap and a tensioning cable secured to the strap.

BACKGROUND

Footwear may include a sole structure configured to be located under a wearer's foot to space the foot away from the ground. A footwear upper attached to the sole structure receives the foot. The fit of the upper to the foot may be adjusted with a closure system so that the upper is loose enough to receive the foot but can be tightened around the foot to secure the foot relative to the sole structure. For example, a closure system, such as a lacing system, may include laces that are tied once the foot is received within the upper.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
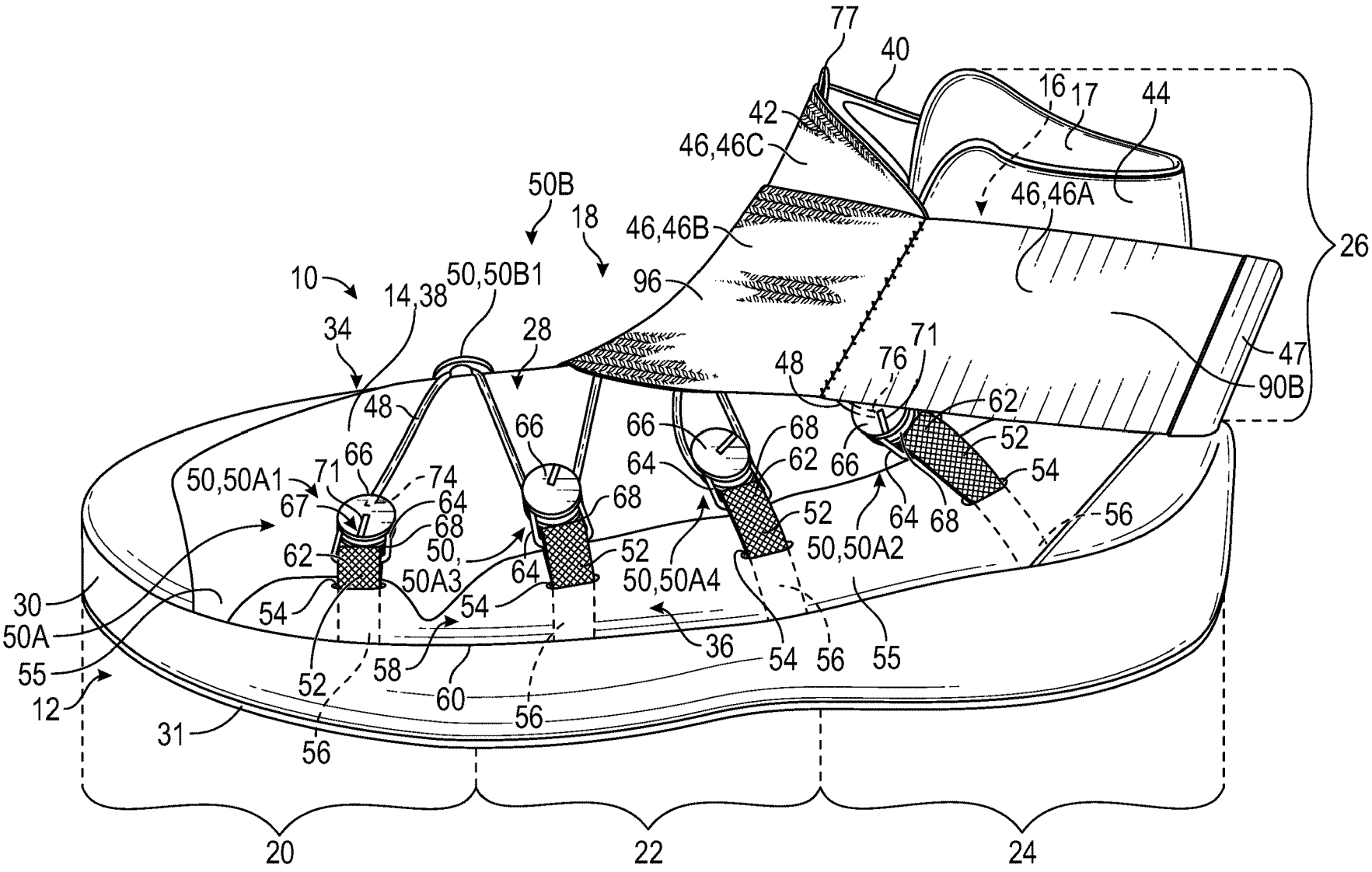
FIG. 1 is a perspective view of a lateral side of an article of footwear having an upper and a closure system with a strap in a fastened position.

The present disclosure generally relates to an article of footwear that has a closure system for securing an upper around a foot. The closure system includes a strap and a tensioning cable secured to the strap. A single pull of the strap tightens the tensioning cable which tightens the upper around the foot. The strap may have a two-point connection on a side of the upper and pulleys may be used to route the tensioning cable over the upper. Both the two-point connection of the strap and the arrangement of the pulleys enable a more even distribution of tightening forces on the upper to better conform the upper to the foot.

In an example, an article of footwear may comprise an upper and a closure system. The closure system may include a strap, a tensioning cable, and a plurality of pulleys. The strap may have a fixed end fixed relative to the upper, a free end selectively securable to the upper in a fastened position, and an elastic portion between the fixed end and the free end. The closure system may include a tensioning cable anchored to the upper and secured to the strap. The closure system may also include a plurality of pulleys anchored to the upper and engaging the tensioning cable. The tensioning cable may be configured to tighten against the upper when the elastic portion of the strap stretches as the free end of the strap is pulled.

In one or more configurations, the tensioning cable has a first end and a second end both anchored to the upper, and a midportion secured to the strap. In an aspect, the plurality of pulleys may engage the tensioning cable between the first end and the midportion, or between the second end and the midportion, or between both the first end and the midportion and the second end and the midportion. The fixed end of the strap may be fixed to a first side of the upper, and the first end and the second end of the tensioning cable may be anchored to a second side of the upper.

The tensioning cable may be unitary or segmented. In an example having a unitary tensioning cable, the midportion may be continuous, and the tensioning cable may include only two ends: the first end and the second end. In a segmented tensioning cable, the tensioning cable may be two discontinuous segments, so that a first segment of the tensioning cable extends from the first end anchored to the upper to an end secured to the strap, and a second segment of the tensioning cable extends from the second end anchored to the upper to another end secured to the strap.

In an aspect, the plurality of pulleys may include a medial set of pulleys at a medial side of the upper and a lateral set of pulleys at a lateral side of the upper. In addition, the lateral set of pulleys may include a rearward-most pulley and a forward-most pulley. The first end of the tensioning cable may be fixed to the forward-most pulley, the second end of the tensioning cable may be fixed to the rearward-most pulley, and the midportion of the tensioning cable may be secured to the strap.

In a further aspect, the tensioning cable may cross over the upper from the lateral side of the upper to the medial side of the upper, back to the lateral side of the upper, and then back to the medial side of the upper both between the first end of the tensioning cable and the midportion and between the second end of the tensioning cable and the midportion.

In yet another aspect, the midportion of the tensioning cable may extend at least partially along the strap between the fixed end and the free end. For example, the strap may include an inner layer and an outer layer, and the midportion of the tensioning cable may be disposed between the inner layer and the outer layer of the strap.

In one or more implementations, the fixed end of the strap may include a first branch and a second branch, with the first branch fixed relative to the upper forward of the second branch. In one or more configurations, the first branch and the second branch are disposed at a side of the upper, with the first branch fixed adjacent to a midfoot region of the upper and the second branch fixed adjacent to a heel region of the upper.

In an aspect, the strap may include a main portion extending from the first branch and the second branch to the free end, with the first branch and the second branch diverging from the main portion.

In another aspect, both the first branch and the second branch may include a relatively elastic portion and a relatively inelastic portion, with the relatively elastic portion nearer the free end than the relatively inelastic portion, and the relatively inelastic portion fixed at a side of the upper.

In one or more configurations, the upper may include a rear portion and a front portion. The rear portion and the front portion may together define a foot-receiving void with an ankle opening. The rear portion may be at least partially divided from the front portion along a first side of the upper at the ankle opening. In an aspect, the upper may include an elastic band coupling the rear portion and the front portion along a second side of the upper at the ankle opening. The elastic band may be more elastic than the rear portion and the front portion. For example, the elastic band may have a lower modulus of elasticity than the front portion and the rear portion.

In a further aspect, the strap is fixed to a medial side of the upper, and the article of footwear may further comprise a first fastening feature and a second fastening feature. The first fastening feature may be secured to a lateral side of the upper at a heel region of the upper, and the second fastening feature may be disposed on the strap at the free end and configured to releasably secure to the first fastening feature. In an example configuration, one of the first fastening feature and the second fastening feature may include a plurality of hooks, and one of the first fastening feature and the second fastening feature may include a plurality of loops.

In another aspect, the article of footwear may further comprise a plurality of anchoring straps having fixed ends disposed adjacent to a lower periphery of the upper and having free ends opposite the fixed ends. The plurality of pulleys may be secured to the free ends of the plurality of anchoring straps.

In an example, an article of footwear may comprise an upper and a closure system. The closure system may include a strap and a tensioning cable. The strap may have a main portion with a free end, a front branch, and a rear branch. The front branch and the rear branch may diverge from the main portion. The front branch may be fixed at a first location at a first side of the upper, and the rear branch may be fixed at a second location at the first side of the upper and rearward of the front branch. At least a portion of the strap may be elastic. The tensioning cable may have a first end and a second end both anchored to a second side of the upper. The tensioning cable may have a midportion secured to the strap. The tensioning cable may overlay the upper between the first end and the midportion, and between the second end and the midportion. The tensioning cable may tighten against the upper when the strap is pulled, and the free end of the strap may be selectively securable to the upper in a fastened position that maintains tension in the tensioning cable.

In an aspect, the article of footwear may further comprise a plurality of pulleys anchored to the upper and engaging the tensioning cable between the first end and the midportion, or between the second end and the midportion, or between both the first end and the midportion and the second end and the midportion.

In another aspect, the article of footwear may further comprise a plurality of anchoring straps having fixed ends disposed adjacent to a lower periphery of the upper and free ends opposite the fixed ends. The plurality of pulleys may be secured to the free ends of the plurality of anchoring straps.

The above features and advantages and other features and advantages of the present teachings are readily apparent from the following detailed description of the modes for carrying out the present teachings when taken in connection with the accompanying drawings.

Referring to the drawings, wherein like reference numbers refer to like components, FIG. 1 shows an article of footwear 10 that has a sole structure 12 and an upper 14 secured to the sole structure 12. The upper 14 forms a foot-receiving cavity 16 configured to receive a foot (not shown) through an ankle opening 17. The upper 14 is tightened and secured around the foot with a closure system 18.

The footwear 10 illustrated herein is depicted as athletic footwear configured for sports such as basketball, but the footwear 10 and closure system 18 are not limited to basketball shoes or other sports shoes. The closure system 18 and other features of the article of footwear 10 may be also be used in footwear for various other sports such as but not limited to running, tennis, football, soccer, etc. or in other types of footwear, such as in an article of footwear that is a leisure shoe, a dress shoe, a work shoe, a sandal, a slipper, a boot, or any other category of footwear.

As indicated in FIG. 1, the footwear 10 may include a forefoot region 20, a midfoot region 22, a heel region 24, and an ankle region 26. The forefoot region 20, the midfoot region 22, the heel region 24, and the ankle region 26 are not intended to demarcate precise areas of the footwear 10, but are instead intended to represent general areas of the footwear 10 to aid in the following discussion. The forefoot region 20 generally includes portions of the article of footwear 10 corresponding with the toes and the joints connecting the metatarsals with the phalanges. The midfoot region 22 generally includes portions of the article of footwear 10 corresponding with the arch area and instep of the foot. An instep portion 28 of the upper 14, also referred to as a top portion, extends over the top of the foot in the forefoot region 20 and the midfoot region 22. The heel region 24 corresponds with rear portions of the foot, including the calcaneus bone. The ankle region 26 corresponds with the ankle.

The sole structure 12 includes a midsole 30 and an outsole 31. The midsole 30 may be formed from a compressible polymer foam element (e.g., a polyurethane or ethylvinylacetate foam) that attenuates ground reaction forces (e.g., provides cushioning) when compressed between the foot and the ground during walking, running, or other ambulatory activities. In further configurations, the midsole 30 may incorporate fluid-filled chambers, plates, moderators, or other elements that further attenuate forces, enhance stability, or influence the motions of the foot. The midsole 30 may be a single, one-piece midsole, or could be multiple components integrated as a unit. The outsole 31 may be one-piece, or may be several outsole components, and may be formed from a wear-resistant rubber material that may be textured to impart traction and/or may include traction elements such as cleats secured to the midsole 30. In some embodiments, the midsole 30 may be integrated with the outsole 31 as a unisole.

The footwear 10 has a medial side 34 and a lateral side 36. The medial side 34 is referred to herein as a first side, and the lateral side 36 is referred to as a second side. The medial side 34 and lateral side 36 extend through each of the forefoot region 20, the midfoot region 22, the heel region 24, and the ankle region 26, and correspond with opposite sides of the article of footwear 10, each falling on an opposite side of a longitudinal midline of the article of footwear 10.

The upper 14 may be a variety of materials, such as leather, textiles, polymers, cotton, foam, composites, etc. The upper 14 may include a body 38 of a material that has greater elasticity, greater breathability, or both greater elasticity and greater breathability than the material or materials of other portions of the upper 14 in order to aid with foot insertion and comfort, and in order to permit tightening of the body 38 to the foot. For example, the body 38 may be a polymeric material capable of providing elasticity, and may be of a braided construction, a knitted (e.g., warp-knitted) construction, or a woven construction. A tongue 40 may be integrated with or separately secured to the body 38. The instep portion 28 of the body 38 is disposed between the foot and the closure system 18. As further discussed herein, the upper 14 includes a front portion 42 and a rear portion 44 divided from the front portion 42 to increase ease of foot insertion and removal.

The closure system 18 includes a strap 46, a tensioning cable 48, and a plurality of pulleys 50. As further explained herein, the tensioning cable 48 is fixed to both the strap 46 and the upper 14 (via the pulleys 50) and is tightened against the upper 14 when the strap 46 is pulled. After the strap 46 is pulled, a free end 47 of the strap 46 may then be selectively, e.g., releasably, secured to the upper 14 in a fastened position that maintains the tension in the tensioning cable 48 as shown in FIG. 1. As further explained herein, the strap 46 includes a main portion 46A, a front branch 46B and a rear branch 46C, with the front branch 46B and the rear branch 46C secured to the medial side 34 of the footwear 10.

The pulleys 50 include a lateral set 50A of pulleys 50 at the lateral side 36 of the upper 14. The pulleys 50 also include a medial set 50B of pulleys 50. Only one pulley 50, 50B1 of the medial set 50B is visible in FIG. 1. The lateral set 50A includes a forward-most pulley 50A1 and a rearward-most pulley 50A2. In the embodiment shown, the lateral set 50A includes two additional pulleys 50A3 and 50A4 positioned between the forward-most pulley 50A1 and the rearward-most pulley 50A2 for a total of four pulleys 50 in the lateral set 50A.

A plurality of anchoring straps 52 anchor the pulleys 50 to the upper 14 or to the sole structure 12. The anchoring straps 52 extend through apertures 54 in an outer layer 55 of the upper 14. The outer layer 55 may be a relatively stiff material in comparison to the body 38 of the upper 14, and may provide support to the foot at the lateral side 36. The anchoring straps 52 may extend to fixed ends 56 that may be disposed adjacent to a lower periphery 58 of the upper 14, such as at the biteline 60 where the upper 14 is secured to the sole structure 12. Alternatively, the anchoring straps 52 may instead be shorter, with fixed ends secured to the upper above the biteline 60, or may be longer, extending under the foot along an upper surface of the sole structure 12.

Each anchoring strap 52 has a free end 62 opposite the fixed end 56. Each pulley 50 includes a frame 64 and a pulley wheel 66 mounted to the frame 64. The frame has a slot 68 (e.g., the frame 64 defines or forms a slot 68) through which the free end 62 of the anchoring strap 52 is looped and sewn to itself or otherwise secured to secure the pulley 50 to the anchoring strap 52. Each pulley wheel 66 has an exterior surface 67 with a marking 71. As further explained herein, for those pulley wheels 66 that are rotatable relative to the frame 64 to which they are mounted, the marking 71 moves as the pulley wheel 66 rotates, and serves as a visual indicator of the rotational position of the pulley 50.

The tensioning cable 48 has a first end 74 and a second end 76 both anchored to the upper 14 via a respective pulley 50 and anchoring strap 52. The first end 74 of the tensioning cable 48 is fixed to the forward-most pulley 50A1 and the second end 76 of the tensioning cable is be fixed to the rearward-most pulley 50A2.

Figure 2:
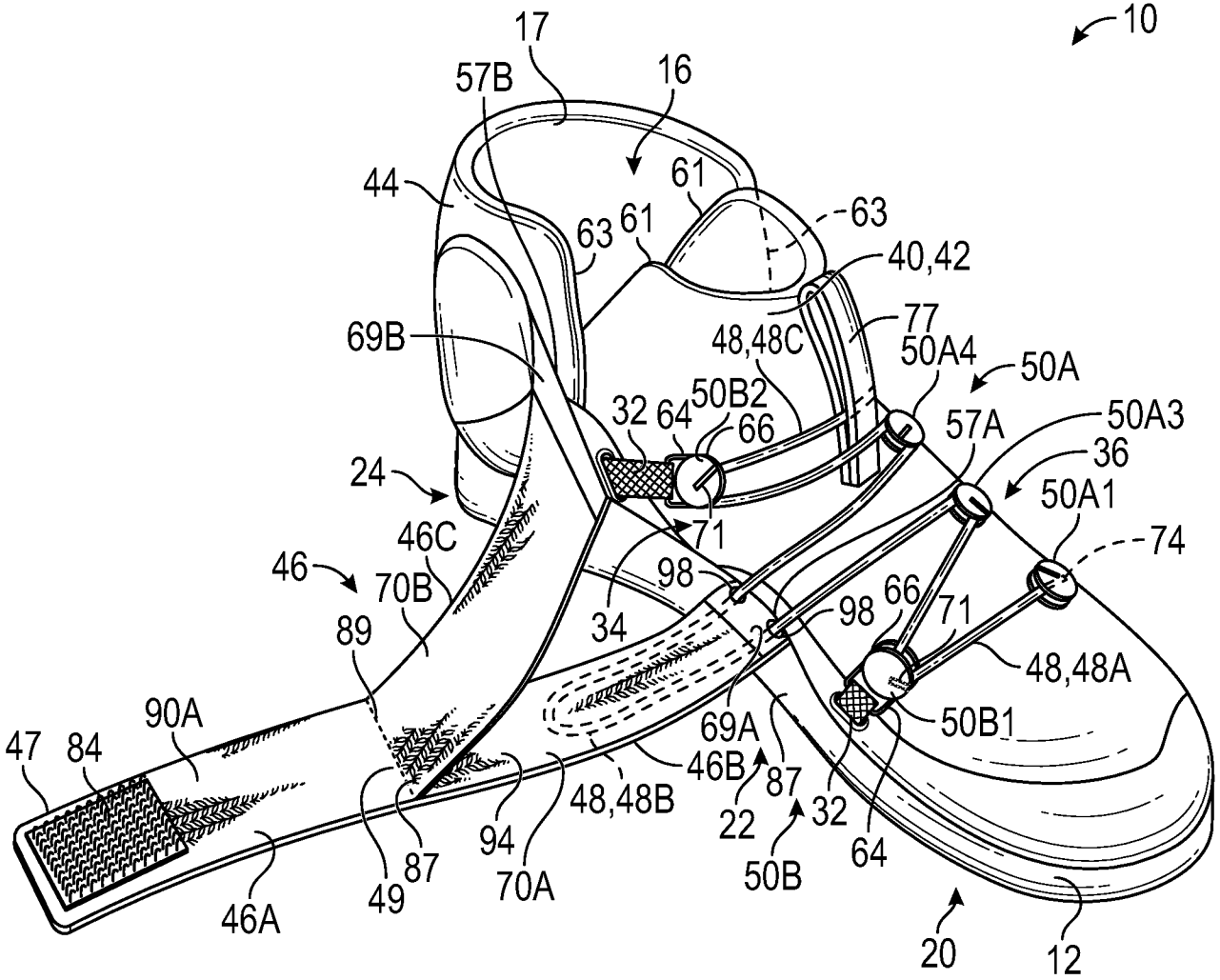
FIG. 2 is a perspective view of a medial side of the article of footwear of FIG. 1 with the strap unfastened.

Referring to FIG. 2, when the strap 46 is not fastened, the divided nature of the front portion 42 and the rear portion 44 at the medial side 34 of the ankle region 26 is apparent. The front portion 42 angles rearward and downward at rear edges 61 that may extend down to the sole structure 12 or may terminate somewhere above the sole structure 12 and be secured to the rear portion 44. The rear portion 44 angles forward and downward at front edges 63 disposed laterally outward of the rear edges 61 of the front portion 42. The front portion 42 may be stretched apart from the rear portion 44 to increase the gap between the edges 61, 63 and the overall size of the ankle opening 17 during foot insertion or removal when the strap 46 is not fastened.

FIG. 2 also shows that the plurality of pulleys 50 includes a medial set 50B of pulleys including a forward medial pulley 50B1 and a rearward medial pulley 50B2. In the embodiment shown, the medial set 50B includes only these two pulleys 50B1, 50B2. The forward-most pulley 50A1 of the lateral set 50A is more forward on the upper 14 than the forward medial pulley 50B1. The rearward most pulley 50A2 of the lateral set 50A is more rearward on the upper 14 than the rearward medial pulley 50B2. This relative positioning, in addition to the medial set 50B having only two pulleys and the lateral set 50A having four pulleys provides a staggered arrangement of the pulleys of the medial set 50B relative to the pulleys of the lateral set 50A in a longitudinal direction of the footwear 10. Like the pulleys of the lateral set 50A, each pulley of the medial set 50B includes a frame 64 and a pulley wheel 66. Anchoring straps 32 anchor the pulleys 50B1 and 50B2 at the medial side of the upper 14 in the same manner as described with respect to the medial set 50B.

The strap 46 has a main portion 46A, a front branch 46B, and a rear branch 46C. The main portion 46A includes the free end 47. A fastening feature 84 (referred to as a second fastening feature) is disposed on an inner layer 90A at an inner side of the main portion 46A at or near the free end 47, and is configured to releasably secure to a fastening feature 86 (shown in FIGS. 4 and 5, referred to as a first fastening feature) secured to the lateral side 36 of the rear portion of the upper 14. The fastening feature 84 on the strap 18 as shown is a portion of a hook and loop fastener, and includes a plurality of hooks. The fastening feature 86 includes a plurality of loops to which the plurality of hooks releasably secures. Alternatively, the fastening feature 84 may include a plurality of loops and the fastening feature 86 may include a plurality of hooks, or both fastening features 84, 86 may include both hooks and loops. Other types of fasteners may be used instead of or in addition to the hook and loop fasteners.

The front branch 46B and the rear branch 46C diverge from one another at the proximal end 49 of the main portion 46A. The front branch 46B has a fixed end 57A fixed at a first location at the medial side 34 of the upper 14. The first location may be the midfoot region 22. The rear branch 46C has a fixed end 57B fixed at a second location rearward of the front branch 46B at the medial side 34 of the upper 14. The second location may be the heel region 24. The fixed ends 57A, 57B are spaced apart from one another at the medial side 34. The front branch 46B and the rear branch 46C may be a continuous strip of material that is folded over itself to form a fold 87 between the two fixed ends 57A, 57B, and stitched or otherwise secured to the proximal end 49 of the main portion 46A with stitching 89 at the fold 87 so that the front branch 46B and rear branch 46C form a V shape.

The front branch 46B includes a relatively inelastic portion 69A at the fixed end 57A, and a relatively elastic portion 70A between the fixed end 57A and the main portion 46A. Similarly, the rear branch 46C includes a relatively inelastic portion 69B at the fixed end 57B, and a relatively elastic portion 70B between the fixed end 57B and the main portion 46A. For example, the relatively inelastic portions 69A, 69B may be natural or synthetic leather or suede, or another relatively inelastic material. The relatively elastic portions 70A, 70B may be a knitted, woven, or braided textile that includes an elastic material such as but not limited to nylon. The main portion 46A may also be relatively elastic, or could be relatively inelastic. In the embodiment shown, an inner layer 90A of the main portion 46A is a relatively elastic material, and a relatively inelastic outer layer 90B of the main portion (shown in FIG. 1) is stitched to the relatively elastic inner layer 90A and inhibits the ability of the main portion 46A to stretch.

The tensioning cable 48 includes a midportion 48B secured to the strap 46. The midportion 48B extends at least partially along the front branch 46B of the strap 46 between the fixed end 57A and the free end 47. For example, the front branch 46B of the strap 46 may include an inner layer 94 and an outer layer 96 (shown in FIG. 1), and the midportion 48B of the tensioning cable 48 may be disposed between the inner layer 94 and the outer layer 96 of the front branch 46B of the strap 46. The midportion 48B is secured to one or both of the inner layer 94 and the outer layer 96 so that the midportion 48B will be moved with and tensioned by the strap 46 when a pulling force is exerted on the strap 46 pulling the front branch 46B away from the fixed ends 57A, 57B.

The tensioning cable 48 enters through apertures 98 in the relatively inelastic portion 69A of the front branch 46B and is disposed between and is secured to the inner layer 94 and the outer layer 96 (see FIG. 1) of the relatively elastic portion 70A of the front branch 46B. In other embodiments, the tensioning cable 48 could simply be stitched or otherwise secured anywhere to the strap 46, and could be between layers of the strap 46 or instead could be exposed on an outer surface of the strap 46 where it is secured. The tensioning cable 48 overlays the upper 14 between the first end 74 and the midportion 48B, and between the second end 76 and the midportion 48B. A first portion 48A of the tensioning cable 48 extends from the first end 74 to the front branch 46B of the strap 46. A second portion 48C of the tensioning cable 48 extends from the second end 76 to the front branch 46B. The second portion 48C passes through a retention loop 77 secured to the tongue 40 between the second end 76 and the pulley 50B2.

The tensioning cable 48 is a unitary tensioning cable, as the midportion 48B is continuous in that the tensioning cable 48 has no ends in the midportion 48B. Instead, the tensioning cable 48 has only two ends: the first end 74 and the second end 76. Alternatively, instead of forming a U-shape, the midportion 48B could include two discontinuous linear segments secured to the front branch 46B. For example, a first segment of the tensioning cable would extend from the first end 74 to an end secured to the strap 46 (e.g., including the first portion 48A and a linear section within the front branch 46B), and a second segment of the tensioning cable would extend from the second end 76 to another end secured to the strap (e.g., including the second portion 48C and a separate linear section within the front branch 46B).

The first end 74 is fixed to the forward-most pulley 50A1 and the second end 76 is fixed to the rearward-most pulley 50A2, such as by tying the end to a hub 105 extending from the pulley wheel 66 or gluing the end to the pulley 50. Accordingly, the tensioning cable 48 does not slide around the pulleys 50A1 and 50A2 as it does around the other pulleys 50. With this arrangement, the first end 74 and the second end 76 of the tensioning cable 48 are anchored to the second side (lateral side 36) of the upper 14 at pulleys 50A1, 50A2, and the fixed ends 57A, 57B of the branches 46B, 46C of the strap 46 are fixed to a first side (medial side 34) of the upper 14.

The first portion 48A of the tensioning cable 48 crosses over the upper 14, and the foot-receiving cavity 16 therein, from the lateral side 36 of the upper 14 at the first end 74 to the medial side 34 of the upper 14 where it is routed around the forward-most pulley 50B1 of the medial set 50B, and then back to the lateral side 36 where it is routed around the second pulley 50A3 of the lateral set 50A (e.g., the pulley next rearward of the pulley 50A1), and then crosses over the upper 14 back to the medial side 34 where it enters through the aperture 98 into and to extend along the front branch 46B at the midportion 48B. Similarly, the second portion 48C of the tensioning cable 48 crosses over the upper 14, and the foot-receiving cavity 16 therein, from the lateral side 36 of the upper 14 at the second end 76 to the medial side 34 of the upper 14 where it is routed around the rearward-most pulley 50B2 of the medial set 50B, and then back to the lateral side 36 where it is routed around the third pulley 50A4 of the lateral set 50A (e.g., the next pulley forward of the pulley 50A2), and then crosses over the upper 14 back to the medial side 34 where it enters through the aperture 98 into and to extend along the front branch 46B at the midportion 48B.

Accordingly, the pulleys 50B1 and 50A3 engage the tensioning cable 48 between the first end 74 and the midportion 48B, and the pulleys 50B2 and 50A4 engage the tensioning cable 48 between the second end 76 and the midportion 48B. With this arrangement, the tensioning cable 48 extends over a broad area of the instep portion 28 of the upper 14 from the forefoot region 20 to just forward of the heel region 24 in order to better distribute force of the tensioning cable 48 on the upper 14 and the foot therein. Alternatively, a closure system could include a plurality of pulleys that engage the tensioning cable only between the first end 74 and the midportion 48B, or only between the second end 76 and the midportion 48B. For example, one end of the tensioning cable 48 could be anchored to the upper 14 and extend to the midportion 48B without any pulleys engaging the tensioning cable 48 between the end and the midportion 48B, the pulleys instead all being between the other end of the tensioning cable 48 and the midportion 48B.

Figure 3:
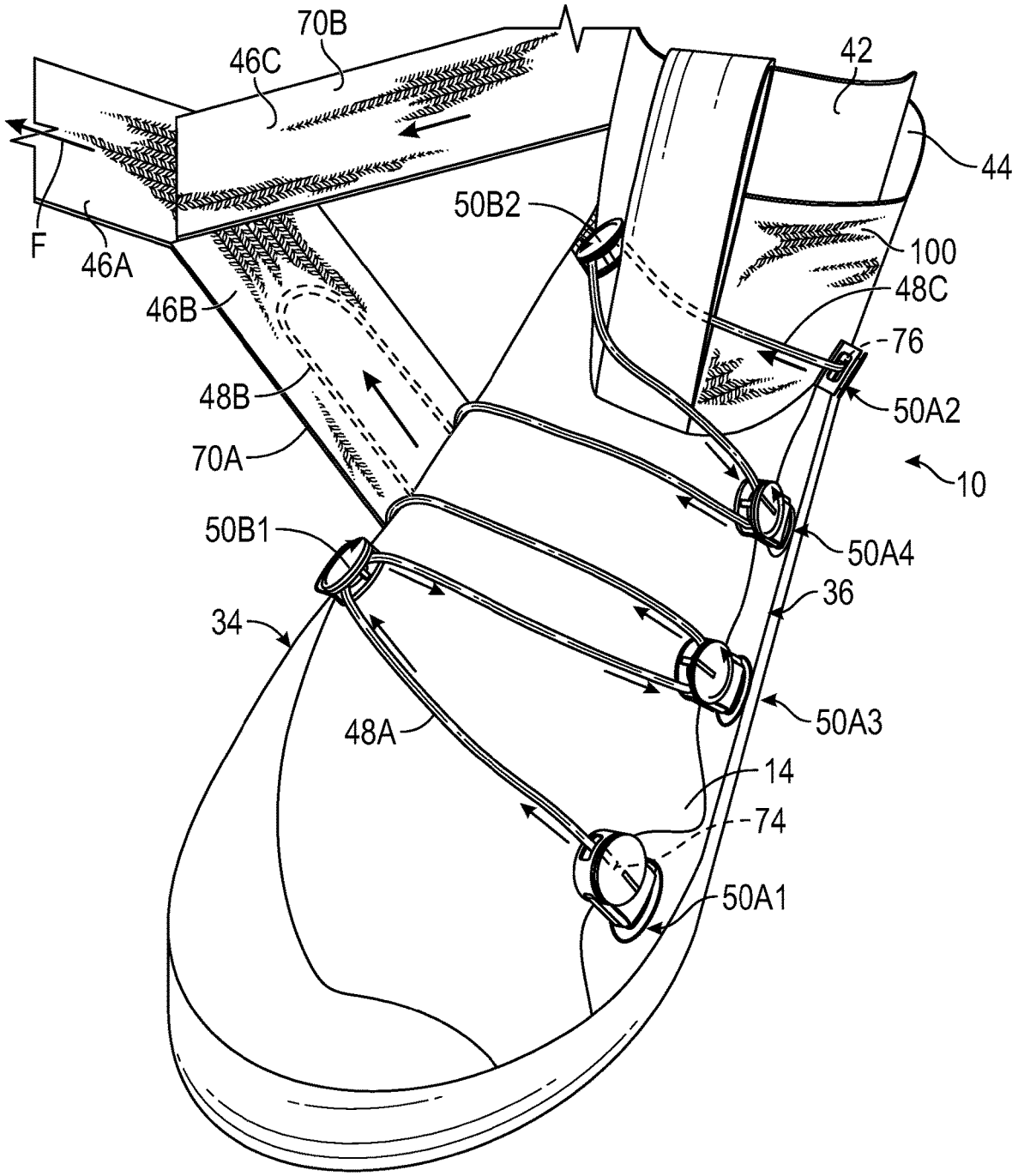
FIG. 3 is a fragmentary perspective view of the article of footwear of FIG. 1 showing a tensioning cable routed around pulleys and tightening against the upper when the strap is pulled.

FIG. 3 illustrates the effect of a force F pulling the strap 46 away from the upper 14 to cause tightening of the tensioning cable 48. As the strap 46 is pulled, the relatively elastic portions 70A and 70B will stretch and therefor lengthen. Because the tensioning cable 48 is relatively inelastic, the midportion 48B will move with the stretching relatively elastic portion 70A but will not stretch. Instead, because the midportion 48B is secured to the front branch 46B, it will cause a greater portion of the length of the tensioning cable 48 to extend along the lengthening front branch 46B, such as by sliding through the apertures 98 (see FIG. 1) into the front branch 46B. The additional length of the tensioning cable 48 made to extend along the lengthening front branch 46B at the midportion 48B will come from slack in the first portion 48A and the second portion 48C. The direction of movement of the tensioning cable 48 at each of the pulleys 50 is illustrated with arrows in FIG. 3. The ends 74, 76 will remain fixed at the pulleys 50A1, 50A2, respectively, and, because more of the tensioning cable 48 must slide through the apertures 98 to extend along the stretched relatively elastic portion 70A, the total length of the portion of the tensioning cable 48 from the first end 74 to the apertures 98 at the front branch 46B, as well as the total length of the portion of the tensioning cable 48 from the second end 76 to the aperture 98 at the front branch 46B will decrease. Due to the shorter length of the portion of the tensioning cable 48 that is directly overlaying the upper 14, the tensioning cable 48 tightens against the upper 14 when the relatively elastic portion 70A of the front branch 46B stretches as the free end 47 of the strap 46 is pulled. This causes the total volume of the foot-receiving cavity 16 around the foot to decrease, tightening the upper 14 to the foot and conforming the upper 14 to the foot.

Figure 6:
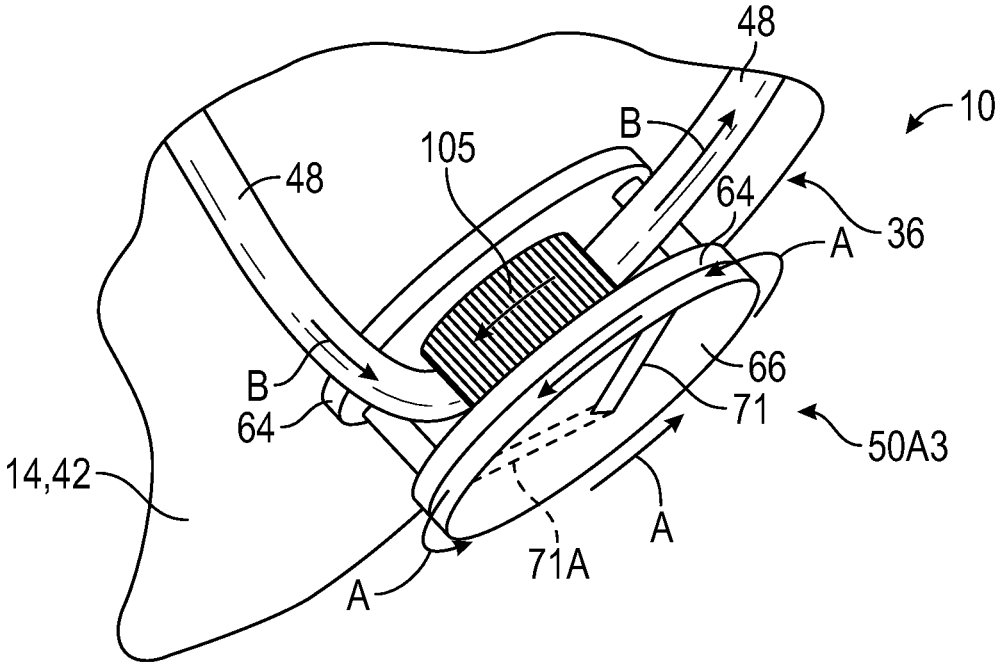
FIG. 6 is a perspective fragmentary close-up view of a pulley included in the closure system and around which the tensioning cable is routed.

As discussed with respect to FIG. 6, at all pulleys 50 except for at the two pulleys 50A1, 50A2 where the tensioning cable 48 is fixed, the pulley wheels 66 are caused to rotate by the friction of the tensioning cable 48 moving around and in contact with a hub 105 extending from the pulley wheels 66 (one hub 105 indicated in FIG. 3). A connecting leg 73 of the frame 64 extends parallel with the hub 105 and connects top and bottom portions of the frame 64. The direction of rotation of pulley wheels 66 at pulleys 50B1, 50B2, 50A3, and 50A4 is illustrated with an arrow at each pulley 50B1, 50B2, 50A3, and 50A4 in FIG. 3. As the pulley wheels 66 rotate, the marking 71 thereon moves with the pulley wheel 66. The markings 71 are radially-extending lines. Accordingly, the angular position of the marking 71 changes as the cable 48 is tightened, and is a visual indicator of the tightness of the tensioning cable 48.

Figure 4:
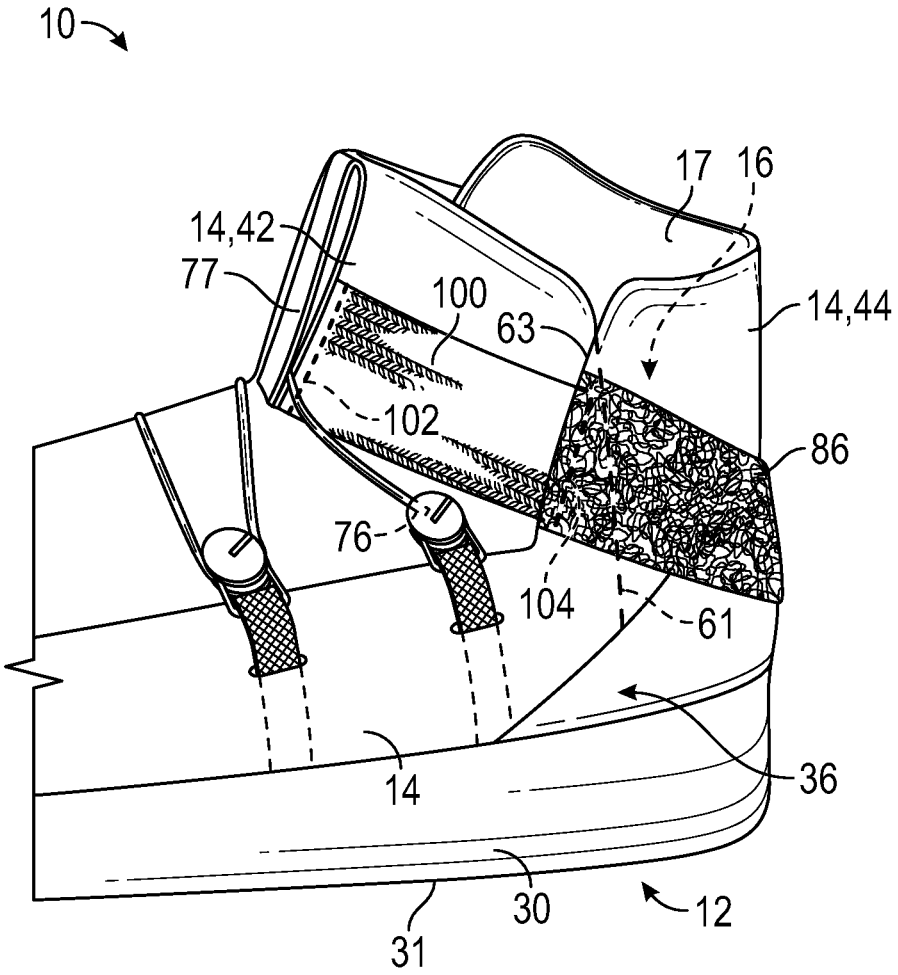
FIG. 4 is a fragmentary perspective view of the lateral side of the article of footwear of FIG. 1 showing a divided front portion and rear portion of the upper, with an elastic band coupling the rear portion and the front portion at a lateral side, and with the strap unfastened and not visible in the view.

Referring to FIG. 4, the upper 14 includes an elastic band 100 coupling the rear portion 44 and the front portion 42 along the lateral side 36 at the ankle opening 17. The elastic band 100 is sewn, adhered, or otherwise secured at a first location to the front portion 42, as indicated by stitches 102. The elastic band 100 is also sewn, adhered, or otherwise secured at a second location to the rear portion 44, as indicated by stitches 104. The portion of the elastic band 100 extending between the locations of the stitches 102, 104 may be detached from the upper 14 so that the elastic band 100 is suspended across the upper 14 between the stitches 102, 104. The elastic band 100 is more elastic than the rear portion 44 and the front portion 42. Accordingly, the elastic band 100 allows the front portion 42 and the rear portion 44 to be further stretched apart from one another at the ankle opening 17 during foot insertion or withdrawal. Additionally, the elastic band 100 serves to maintain the rear portion 44 snugly against the ankle at the lateral side 36. Because the first fastening feature 86 is immediately rearward of the elastic band 100 on the lateral side 36, this aids in repeatability of easy and accurate placement of the strap 46 when securing the second fastening feature 84 to the first fastening feature 86.

Figure 5:
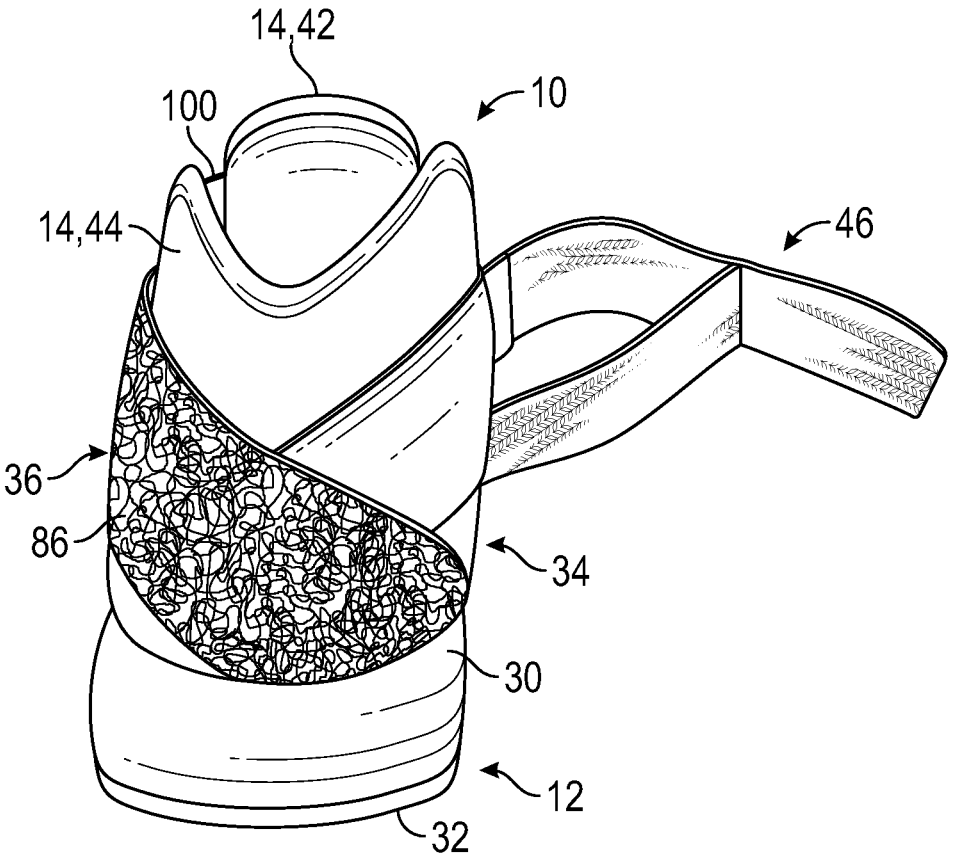
FIG. 5 is a rear perspective view of the article of footwear with the strap unfastened.

Referring to FIG. 5, the first fastening feature 86 extends downwardly and rearwardly around the rear of the upper 14 from the lateral side 36 to the medial side 34. This downward and rearward extension of the first fastening feature 86 follows the direction of extension of the strap 46 when the free end 47 is secured to the upper 14. In extending from the front edge 63 of the rear portion 44 at the lateral side 36 all the way around to the medial side 34, the first fastening feature 86 has a greater surface area and is longer than the second fastening feature 84. This enables the second fastening feature 84 to be positioned as necessary along the first fastening feature 86 to maintain the stretch in the relatively elastic portion 70A and the resulting tension in the tensioning cable 48 after the free end 47 of the strap 46 is pulled to tighten the tensioning cable 48 and is then selectively secured to the upper 14 in the fastened position of FIG. 1.

FIG. 6 shows a close-up perspective view of the tensioning cable 48 routed through the pulley 50A3, with the front portion 42 of the upper 14 in fragmentary view. More specifically, the tensioning cable 48 is routed around a hub 105 that is fixed to and extends from the center of the pulley wheel 66. The connecting leg 73 extends parallel with the hub 105 and connects top and bottom portions of the frame 64. The pulley wheel is mounted to and is rotatable relative to the frame 64. The frame 64 is anchored to the upper 14 at the lateral side 36 by the anchoring strap 52 (not visible in FIG. 6). The tensioning cable 48 engages the hub 105 to cause the hub 105 and the pulley wheel 66 to rotate. The direction of rotation of the hub 105 and the pulley wheel 66 is indicated by arrows A and is in response to tightening of the tensioning cable 48 as indicated by arrows B. As the pulley wheel 66 rotates, the marking 71 thereon moves with the pulley wheel 66. The markings 71 are radially-extending lines, but other shapes or images could be used that act as a visual indicator of the rotation. Accordingly, the angular position of the marking 71 is a visual indicator of the tightening of the tensioning cable 48. For example, the marking 71 is shown moved to a new position 71A, that, with repeated use, a wearer may learn is associated with a specific desired degree of tightness.

Accordingly, the article of footwear 10 and closure system 18 provide both easy entry and easy tightening of the upper 14 for a secure fit. The pulleys 50 and tensioning cable 48 help to distribute the tightening forces over a large portion of the upper 14, and the fastening features 84, 86 enable the strap 46 to be secured at the position chosen by the wearer to adjust the tightness.

The following Clauses provide example configurations of an article of footwear disclosed herein.

Clause 1: An article of footwear comprising: an upper; a closure system including: a strap having a fixed end fixed relative to the upper, a free end selectively securable to the upper in a fastened position, and an elastic portion between the fixed end and the free end; a tensioning cable anchored to the upper and secured to the strap; and a plurality of pulleys anchored to the upper and engaging the tensioning cable; wherein the tensioning cable is configured to tighten against the upper when the elastic portion of the strap stretches as the free end of the strap is pulled.

Clause 2: The article of footwear of Clause 1, wherein: the tensioning cable has a first end and a second end both anchored to the upper; and the plurality of pulleys engages the tensioning cable between the first end and the midportion, or between the second end and the midportion, or between both the first end and the midportion and the second end and the midportion.

Clause 3: The article of footwear of Clause 1, wherein: the tensioning cable has a first end and a second end both anchored to the upper; and the fixed end of the strap is fixed to a first side of the upper, and the first end and the second end of the tensioning cable are anchored to a second side of the upper.

Clause 4: The article of footwear of any of Clauses 1-3, wherein the plurality of pulleys includes a medial set of pulleys at a medial side of the upper and a lateral set of pulleys at a lateral side of the upper.

Clause 5: The article of footwear of Clause 4, wherein: the lateral set of pulleys includes a rearward-most pulley and a forward-most pulley; and a first end of the tensioning cable is fixed to the forward-most pulley, a second end of the tensioning cable is fixed to the rearward-most pulley, and a midportion of the tensioning cable is secured to the strap.

Clause 6: The article of footwear of Clause 4, wherein the tensioning cable crosses over the upper from the lateral side of the upper to the medial side of the upper, back to the lateral side of the upper, and then back to the medial side of the upper both between the first end of the tensioning cable and the midportion and between the second end of the tensioning cable and the midportion.

Clause 7: The article of footwear of any of Clauses 1-6, wherein the fixed end of the strap includes a first branch and a second branch, with the first branch fixed relative to the upper forward of the second branch.

Clause 8: The article of footwear of Clause 7, wherein the first branch and the second branch are disposed at a side of the upper, with the first branch fixed adjacent to a midfoot region of the upper and the second branch fixed adjacent to a heel region of the upper.

Clause 9: The article of footwear of Clause 7, wherein the strap includes a main portion extending from the first branch and the second branch to the free end, the first branch and the second branch diverging from the main portion.

Clause 10: The article of footwear of Clause 7, wherein both the first branch and the second branch include a relatively elastic portion and a relatively inelastic portion, the relatively elastic portion nearer the free end than the relatively inelastic portion, and the relatively inelastic portion fixed at a side of the upper.

Clause 11: The article of footwear of any of Clauses 1-10, wherein the upper includes a rear portion and a front portion, the rear portion and the front portion together defining a foot-receiving void with an ankle opening, the rear portion at least partially divided from the front portion along a first side of the upper at the ankle opening.

Clause 12: The article of footwear of Clause 11, wherein the upper includes an elastic band coupling the rear portion and the front portion along a second side of the upper at the ankle opening, the elastic band being more elastic than the rear portion and the front portion.

Clause 13: The article of footwear of any of Clauses 1-12, wherein the strap is fixed to a medial side of the upper, and the article of footwear further comprising: a first fastening feature secured to a lateral side of the upper at a heel region of the upper; and a second fastening feature disposed on the strap at the free end and configured to releasably secure to the first fastening feature.

Clause 14: The article of footwear of Clause 13, wherein one of the first fastening feature and the second fastening feature includes a plurality of hooks, and one of the first fastening feature and the second fastening feature includes a plurality of loops.

Clause 15: The article of footwear of any of Clauses 1-14, further comprising: a plurality of anchoring straps having fixed ends disposed adjacent to a lower periphery of the upper and free ends opposite the fixed ends; and wherein pulleys of the plurality of pulleys are secured to the free ends of the plurality of anchoring straps.

Clause 16: The article of footwear of Clause 1, wherein: the tensioning cable has a first end and a second end both anchored to the upper; and the midportion of the tensioning cable extends at least partially along the strap between the fixed end and the free end.

Clause 17: The article of footwear of Clause 16, wherein the strap includes an inner layer and an outer layer, and the midportion of the tensioning cable is disposed between the inner layer and the outer layer of the strap.

Clause 18: An article of footwear comprising: an upper; a closure system including: a strap having a main portion with a free end, a front branch, and a rear branch; wherein the front branch and the rear branch diverge from the main portion, the front branch is fixed at a first location at a first side of the upper, and the rear branch is fixed at a second location at the first side of the upper and rearward of the front branch; wherein at least a portion of the strap is elastic; and a tensioning cable having a first end and a second end both anchored to the upper at a second side of the upper, and having a midportion secured to the strap; wherein the tensioning cable overlays the upper between the first end and the midportion, and between the second end and the midportion; wherein the tensioning cable tightens against the upper when the strap is pulled, and the free end of the strap is selectively securable to the upper in a fastened position that maintains tension in the tensioning cable.

Clause 19: The article of footwear of Clause 18, further comprising: a plurality of pulleys anchored to the upper and engaging the tensioning cable between the first end and the midportion, and between the second end and the midportion.

Clause 20: The article of footwear of Clause 19, further comprising: a plurality of anchoring straps having fixed ends disposed adjacent to a lower periphery of the upper and free ends opposite the fixed ends; wherein pulleys of the plurality of pulleys are secured to the free ends of the plurality of anchoring straps.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. As used in the description and the accompanying claims, a value is considered to be "approximately" equal to a stated value if it is neither more than 5 percent greater than nor more than 5 percent less than the stated value. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

an upper having a first side and a second side opposite from the first side along a longitudinal midline of the article of footwear;

a closure system including:

a strap having a fixed end fixed to the first side of the upper, a free end selectively securable to the upper in a fastened position, and an elastic portion between the fixed end and the free end; wherein the fixed end of the strap includes a first branch and a second branch both fixed to the first side of the upper; wherein the strap includes a main portion having a proximal end at the first branch and the second branch, the main portion extending from the proximal end to the free end, and the first branch and the second branch diverging from the main portion at the proximal end of the main portion;

a tensioning cable having a first end and a second end both anchored to the upper at the second side of the upper and the tensioning cable having a midportion secured to, disposed on, and extending lengthwise along the first branch of the strap at least partway from the fixed end to the proximal end at the first side of the upper; and a plurality of pulleys anchored to the upper and engaging the tensioning cable;

wherein the tensioning cable is configured to tighten against the upper when the elastic portion of the strap stretches as the free end of the strap is pulled.

2. The article of footwear of claim 1, wherein:

the plurality of pulleys engages the tensioning cable between the first end and the midportion, or between the second end and the midportion, or between both the first end and the midportion and the second end and the midportion.

3. The article of footwear of claim 1, wherein:

the first side is a medial side and the second side is a lateral side; and the plurality of pulleys includes a medial set of pulleys at the medial side of the upper and a lateral set of pulleys at the lateral side of the upper.

4. The article of footwear of claim 3, wherein:

the lateral set of pulleys includes a rearward-most pulley and a forward-most pulley; and the first end of the tensioning cable is fixed to the forward-most pulley, and the second end of the tensioning cable is fixed to the rearward-most pulley.

5. The article of footwear of claim 4, wherein the tensioning cable crosses over the upper from the lateral side of the upper to the medial side of the upper, back to the lateral side of the upper, and then back to the medial side of the upper both between the first end of the tensioning cable and the midportion and between the second end of the tensioning cable and the midportion.

6. The article of footwear of claim 1, wherein the first branch is fixed relative to the upper forward of the second branch.

7. The article of footwear of claim 6, wherein the first branch is fixed adjacent to a midfoot region of the upper and the second branch is fixed adjacent to a heel region of the upper.

8. The article of footwear of claim 6, wherein both the first branch and the second branch include a relatively elastic portion and a relatively inelastic portion, the relatively elastic portion nearer the free end than the relatively inelastic portion, and the relatively inelastic portion fixed at the first side of the upper.

9. The article of footwear of claim 1, wherein the upper includes a rear portion and a front portion, the rear portion and the front portion together defining a foot-receiving void with an ankle opening, the rear portion at least partially divided from the front portion along the first side of the upper at the ankle opening.

10. The article of footwear of claim 9, wherein the upper includes an elastic band coupling the rear portion and the front portion along the second side of the upper at the ankle opening, the elastic band being more elastic than the rear portion and the front portion.

11. The article of footwear of claim 1, wherein the first side is a medial side and the second side is a lateral side, the strap is fixed to the medial side of the upper, and the article of footwear further comprising:

a first fastening feature secured to the lateral side of the upper at a heel region of the upper; and a second fastening feature disposed on the strap at the free end and configured to releasably secure to the first fastening feature.

12. The article of footwear of claim 11, wherein one of the first fastening feature and the second fastening feature includes a plurality of hooks, and one of the first fastening feature and the second fastening feature includes a plurality of loops.

13. The article of footwear of claim 1, further comprising:

a plurality of anchoring straps having fixed ends disposed adjacent to a lower periphery of the upper and free ends opposite the fixed ends; and wherein pulleys of the plurality of pulleys are secured to the free ends of the plurality of anchoring straps.

14. The article of footwear of claim 1, wherein the first branch of the strap includes an inner layer and an outer layer, and the midportion of the tensioning cable is disposed between the inner layer and the outer layer of the first branch of the strap.

15. An article of footwear comprising:

an upper having a first side and a second side opposite from the first side along a longitudinal midline of the article of footwear;

a closure system including:

a strap having a main portion with a free end and a proximal end, a front branch, and a rear branch; wherein the front branch and the rear branch diverge from the main portion at the proximal end of the main portion, the front branch is fixed at a first location at the first side of the upper, and the rear branch is fixed at a second location at the first side of the upper and rearward of the front branch; wherein at least a portion of the strap is elastic; and a tensioning cable having a first end and a second end both anchored to the upper at the second side of the upper, and having a midportion secured to, disposed on, and extending lengthwise along the front branch of the strap at least partway from the fixed end to the proximal end at the first side of the upper; wherein the tensioning cable overlays the upper between the first end and the midportion, and between the second end and the midportion;

wherein the tensioning cable tightens against the upper when the strap is pulled, and the free end of the strap is selectively securable to the upper in a fastened position that maintains tension in the tensioning cable.

16. The article of footwear of claim 15, further comprising:

a plurality of pulleys anchored to the upper and engaging the tensioning cable between the first end and the midportion, and between the second end and the midportion.

17. The article of footwear of claim 16, further comprising:

a plurality of anchoring straps having fixed ends disposed adjacent to a lower periphery of the upper and free ends opposite the fixed ends; wherein pulleys of the plurality of pulleys are secured to the free ends of the plurality of anchoring straps.

18. The article of footwear of claim 1, wherein the midportion of the tensioning cable forms a U shape on the first branch.

19. The article of footwear of claim 15, wherein the midportion of the tensioning cable forms a U shape on the first branch.

* * * * *